United States Patent [19]

Eiermann

[11] Patent Number: 4,824,125

[45] Date of Patent: Apr. 25, 1989

[54] AXIAL SEAL FOR A ROTARY-PISTON ENGINE

[75] Inventor: Dankwart Eiermann, Weissensberg-West, Fed. Rep. of Germany

[73] Assignee: Wankel GmbH, Berlin, Fed. Rep. of Germany

[21] Appl. No.: 197,858

[22] Filed: May 24, 1988

[30] Foreign Application Priority Data

May 26, 1987 [DE] Fed. Rep. of Germany ..... 3717800

[51] Int. Cl.[4] ..... F16J 9/12

[52] U.S. Cl. ..... 277/215; 277/1; 277/216

[58] Field of Search ..... 277/207 R, 213–216, 277/1

[56] References Cited

U.S. PATENT DOCUMENTS

| | | | |
|---|---|---|---|
| 1,499,571 | 7/1924 | Davis | 277/215 |
| 1,572,690 | 2/1926 | Seelert | 277/215 |
| 2,226,921 | 12/1940 | Chamberlain | 277/215 |
| 4,557,488 | 12/1985 | Litherland | 277/215 X |

*Primary Examiner*—Robert S. Ward

*Attorney, Agent, or Firm*—Becker & Becker, Inc.

[57] ABSTRACT

An axial sealing arrangement in a rotary-piston engine, comprising a sealing member that is, for example, made of metal, and is inserted into a groove in one surface of an engine component while it bears against the wall of a surface of a second component that moves relative to the first component. On that surface that bears against the low-pressure side wall of the groove, and on that portion facing the base of the groove, the sealing member is provided with a rounded ledge via which it bears against the low-pressure side wall of the groove. In addition, on that side facing the opposite contact surface, the sealing member is provided with recesses which extend transversely with respect to the longitudinal extension of the sealing member, and which may communicate with a groove extending beside the rounded ledge. The recesses open toward the opposite contact surface and thus into the clearance that is to be sealed. The sealing member may be manufactured by rolling a strip between two profiling rollers.

5 Claims, 2 Drawing Sheets

AXIAL SEAL FOR A ROTARY-PISTON ENGINE

BACKGROUND OF THE INVENTION

The present invention relates to an axial sealing arrangement for a rotary-piston engine. A sealing member is movably disposed in a groove provided in one of two components that have opposing parallel surfaces which move relative to one another. The sealing member, in cooperation with sealing bolts disposed at its ends and at bends of the seal boundary formed by the sealing member, seals the associated chamber from the clearance between the parallel surfaces of the components, and thus from the other chambers of the engine.

In internally sealed engines, these grooves extend along the side walls of the rotors or pistons substantially parallel with and close to the edges of the piston flanks. Springs are provided at the bases of these grooves to press the sealing members in such a way that their contact surface will bear against the side walls. At the operating pressure in the associated chamber, the pressurized working medium which enters the groove presses the sealing members againt the radially inner groove wall that is remote from the working chamber, while the contact surface of the sealing members bears against the side wall along which they slide. This seal thus always closes in the manner of a valve when the chamber associated therewith is in the pressurized operating condition.

This condition, however, creates the following problem: between the groove wall and the sealing member there is an oil film which the pressure in the chamber acts upon from the base of the groove, so that a counter-pressure opposing the bearing pressure on the sealing member, and thus a pitching or tilting momentum, will be created on that side of the sealing member which faces the base of the groove. This momentum urges that side of the sealing member which bears against the contact surface away from the chamber and subjects it to torsional stress inside the groove, possibly accompanied by frictional forces. The sealing members are therefore lifted, from the base of the groove, off the groove wall which they are expected to bear against, under the effect of the oil film, which dams up in a wedge-shaped manner. This results in considerable leakage loss of pressurized gas, and in a corresponding charging loss in chambers operating in the intake mode.

Proposals to eliminate these problems have not become known.

It is therefore an object of the present invention to prevent the establishment of a leakage path via the base of the groove of the sealing members as well as between their contact surfaces and the low-pressure groove side.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

The axial sealing arrangement of the present invention is characterized primarily in that the sealing member, on its underside that bears against the low-pressure side of the groove, is provided on that portion that faces the base of the groove, with a ledge that has a rounded bearing surface; in addition, on that side of the ledge remote from the base of the groove and facing the parallel component surface, the underside of the sealing member is also provided with recesses that extend to that contact surface of the sealing member that, remote from the base of the groove, bears against the parallel component surface.

As has been experimentally demonstrated, the sealing members of the present invention no longer permitted any leakage path. The proposed method of their production is inexpensive and does not require any additional step of operation, compared with the conventional rolling method, for the purpose of compacting the material of such sealing members and matching the same in the required manner to the curvature of the associated groove.

Further specific features of the present invention will be described in detail subsequently.

DESCRIPTION OF PREFERRED EMBODIMENTS

Figure 1:
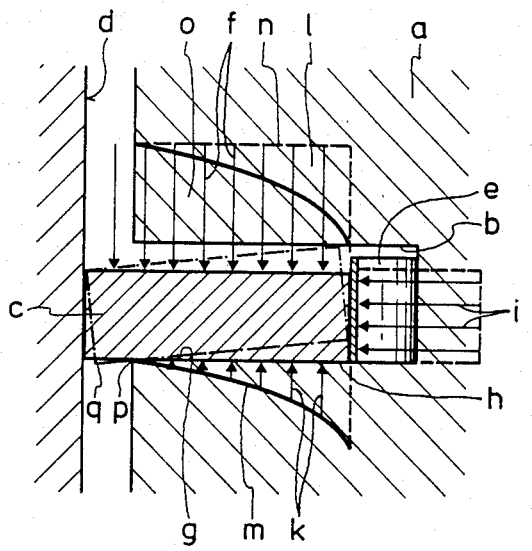
Fig.1 PRIOR ART
FIG. 1 is a radial cross-sectional view through a state-of-the-art sealing member in an internally sealed rotary-piston engine.
Figure 3:
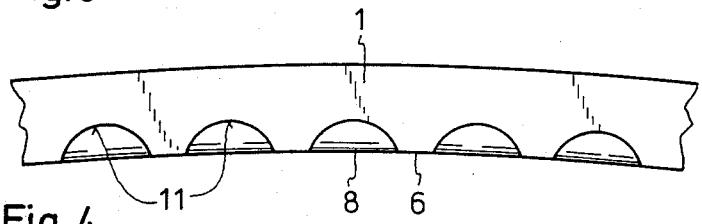
FIG. 3 is a detailed plan view of a sealing member of the present invention, taken in an axial direction towards the piston.
Figure 4:
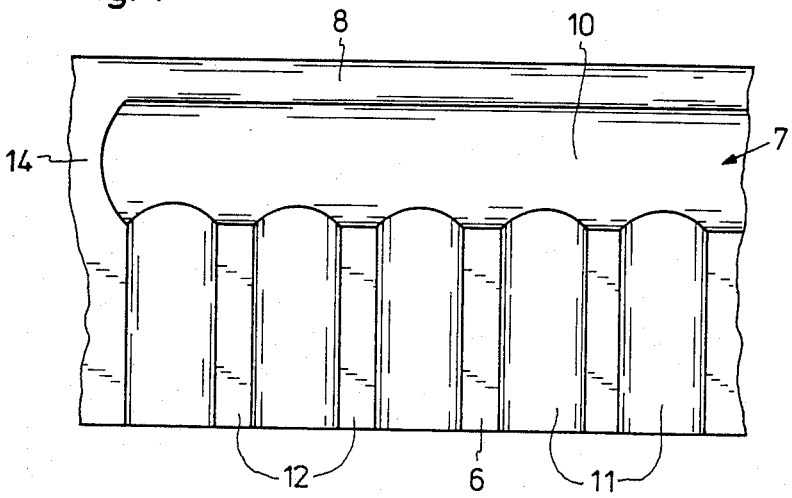
FIG. 4 is a detailed plan view of the same sealing member, seen in a radial direction from the piston axis.
Figure 5:
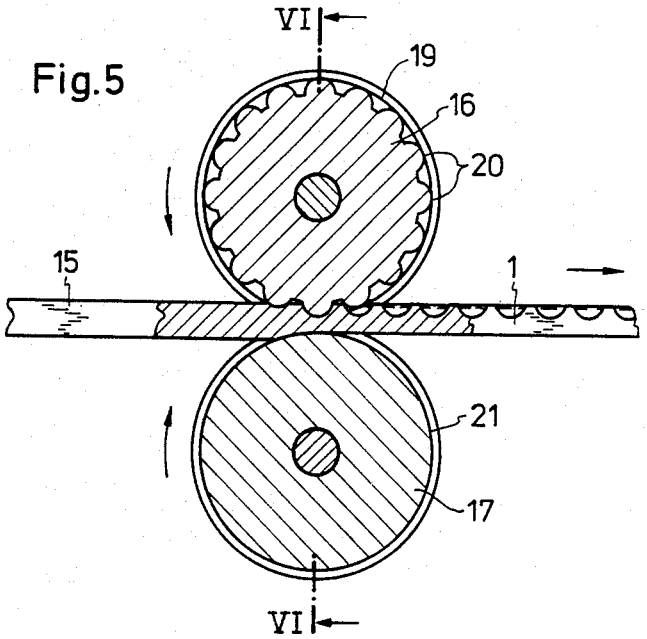
FIG. 5 is a radial cross-sectional view through a profile roller system for manufacturing the sealing members of the present invention, taken in the plane V—V in FIG. 6.
Figure 6:
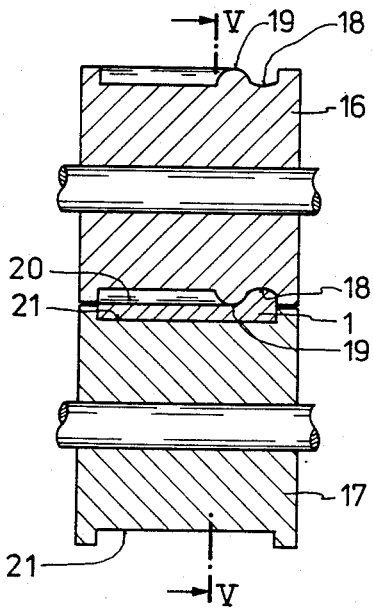
FIG. 6 is an axial cross-sectional view through the same profile roller system, taken in plane VI—VI in FIG. 5.

Referring now to the drawings in detail reference in FIG. 1 indicates a detail of the rotor or piston, and b denotes the groove in which is disposed the sealing member c that contacts or bears against the casing side part d to form a seal. At rest, the corrugated spring e that is provided at the base of the groove b urges the sealing member c against the side wall d of the casing. With the engine operating and a pressure condition being built up in the associated working chamber, this pressure, which is indicated by the arrows f, penetrates into the clearance between the side wall d of the casing and the piston a, pressing the sealing member c against the radially inner low-pressure side g of the groove b and, by entering the base of the groove, against the side wall d of the casing as well.

The oil film between the sealing member c and the low-pressure side groove part g is designated by reference h. This oil film is subjected to the pressure at the base of the groove, represented by the arrows i, so that the oil film adopts a wedge-shaped configuration and slides below the sealing member c. Thus, a pressure acts upon the bearing surface of the sealing member c, as represented by the arrows k; this pressure decreases in the direction towards the side wall d of the casing.

The pressure exerted by the operating medium upon the sealing member c in a direction from the working chamber is represented by the square l; while the triangle m represents the counter-pressure acting upon the underside of the sealing member c. This pressure must be deducted from the pressure that acts upon the upper side of the sealing member c; this situation is illustrated by the triangle n, so that the remaining pressure acting upon the upper side of the sealing member c is only that represented by the area o. Under these pressure conditions, the sealing member o is tilted in the groove b around the corner p at the bottom edge of the groove b into the position designated by q and illustrated by the dot-dash line. The sealing effect of the sealing member c can thus be largely neutralized, with frictional forces, oil accumulation, and vibrations of the resilient sealing adding to this effect.

Figure 2:
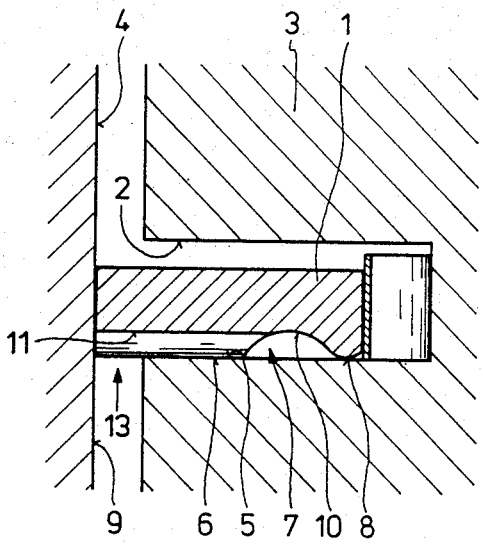
FIG. 2 is a radial cross-sectional view through one exemplary embodiment of a sealing member of the present invention.

In contrast thereto, FIG. 2 illustrates the same arrangement of the axial seal in an application such as in a trochoid-type internal-combustion engine having a bi-arched trochoid surface. However, a sealing member 1 according to the present invention is inserted into the arched groove 2 in the rotor or piston 3 and bears against the side part or wall 4 of the casing to form a seal. At its surface 6, which bears against the radially inner side 5 of the groove, the sealing member 1 is provided with recesses 7. That side of the recesses 7 facing the base of the groove 2 is closed off by a rounded ledge 8, while openings are provided on that side of the recess 7 facing the side wall 4 of the casing so as to relieve the gas pressure, which has built-up under the sealing member, toward the clearance 9 between the side wall 4 of the casing and the piston 3 below the sealing member 1. Therefore, the entire inner edge of the sealing member bears against the inner side 5 of the groove 2 along its entire length in a linear relationship via the flat rounded section of the ledge 8. During tilting movements of the sealing member, which under the prevailing pressure conditions are possibly only in an upward direction, i.e. towards the high-pressure side, and only via the outer edge of the sealing member, a linear sealing effect is always retained due to the fact that the rounded section of the ledge 8 rolls or rides on the inner side 5 of the groove.

In the illustrated embodiment, the recess 7 is formed by a shallow groove 10 which is axially inwardly defined by the ledge 8 and communicates with shallow recesses 11 which extend axially outwardly toward the side wall 4 of the casing; narrow contact surfaces 12 remain between the recesses 11 and extend transversely with respect to the direction of the sealing member 1. At 13, the recesses 11 open into the clearance 9 so that pressurized gas that has penetrated below the sealing member, as well as excess oil, may be carried off into the inner space of the engine, with the requirement that provisions be made for ventilation of this space.

The ends of the groove 10 on the underside of the sealing member 1 are expediently closed in a manner such as shown at 14, so that no communication will be established between the bores of the sealing bolts that are disposed at both sides.

In such an arrangement, the sealing member 1 bears only against the radially inner side 5 of the groove 2 via the rounded section of the ledge 8 and via the contact surfaces 12, which rapidly and automatically reseat themselves. Thus large areas that cannot conform to the roughness of the wall of the groove and cannot seat themselves are avoided, while the sealing member itself is endowed with an increased resilient bendability, due to the recesses 11, which provide for easy adaptation to inaccuracies in shape and especially to distortion under thermal load.

The sealing member of the present invention is expediently produced by rolling a strip 15, preferably of sinter material or metal, having a rectangular or trapezoidal cross-sectional shape between two profiling roll-,ers 16 and 17. The profiling roller 16 is provided with a circumferential recess 18 for producing the rounded ledge 8, a circumferential bulge or protrusion 19 to shape the groove 10, as well as axially extending bulges or protrusions 20 to shape the recesses 11. The counter-roller 17 has a smooth profile 21. During the rolling operation, the curvature of the sealing member, which matches the curvature of the piston flank, is achieved at the same time. The sealings or olosures 14 at the ends of the groove 10 can be produced with an appropriate size of the profiling roller 16 by a discontinuance in the protrusion 19.

The present invention is, of course, in no way restricted to the specific disclosure of the spocification and drawings but also encompasses any modifications within the scope of the appended claims.

What I claim is:

1. In an axial sealing arrangement for a rotary-piston engine, where a sealing member is movably disposed in a groove that is provided in one of two components that have opposing parallel surfaces and that move relative to one another, and where said sealing member, in cooperation with sealing bolts disposed at its ends, and at bends of the seal boundary formed by said sealing member, seals an associated chamber from the clearance between said parallel surfaces of said two components, and hence from the other chambers of said engine, the improvement wherein:

said sealing member has an underside that bears against a low-pressure side of said groove, which also has a base in said one component, said underside of said sealing member being provided, on that portion that is closest to said base of said groove, with a ledge that is rounded where it bears against said low-pressure side of said groove, said underside of said sealing member also being provided, on that side of said ledge remote from said base of said groove and facing said parallel surface of said other component, with recesses that extend to a first contact surface of said sealing member, which first contact surface, remote from said base of said groove, bears against said parallel surface of said other component.

2. An axial sealing arrangement according to claim 1, in which said recesses include shallow recesses that extend transverse to the extension of said sealing member and that are separated from one another by narrow second contact surfaces that bear against said low-pressure side of said groove; and in which said recesses also include a shallow groove that extends parallel to said ledge and is disposed remote from said first contact surface of said sealing member, with said shallow recesses communicating with said shallow groove.

3. An axial sealing arrangement according to claim 2, in which said shallow groove has closed-off ends.

4. An axial sealing arrangement according to claim 2, in which said sealing member is made of sinter metal.

5. A method for manufacturing the sealing member of claim 2, said method including the steps of:

providing two profiling rollers, including a first profiling roller and a counter-roller;

providing said first profiling roller with a circumferential recess for producing said rounded-off ledge, a circumferential protrusion for forming said shallow groove, and further protrusions, which extend transverse to the extension of said sealing member, for forming said shallow recesses;

providing said counter-roller with a smooth profile;

providing a metal strip that has a rectangular cross-sectional shape; and rolling said metal strip between said two profiling rollers.

* * * * *